US006968982B1

(12) United States Patent
Burns

(10) Patent No.: US 6,968,982 B1
(45) Date of Patent: Nov. 29, 2005

(54) MULTIPLE-MIST DISPENSER

(76) Inventor: Caleb E. S. Burns, 4280 Bernard St., Lake Oswego, OR (US) 97035

( * ) Notice: Subject to any disclaimer, the term of this patent is extended or adjusted under 35 U.S.C. 154(b) by 215 days.

(21) Appl. No.: 10/246,181

(22) Filed: Sep. 18, 2002

(51) Int. Cl.[7] ..... B65D 88/54

(52) U.S. Cl. ..... 222/321.7; 222/135; 222/136; 222/137; 222/183

(58) Field of Search ..... 222/129, 131, 222/135–137, 183, 162, 321.7, 321.9, 255, 222/94, 105, 189.06; 239/302–303, 333, 239/370

(56) References Cited

U.S. PATENT DOCUMENTS

| | | | | |
|---|---|---|---|---|
| 3,220,424 A | | 11/1965 | Nelson | |
| 3,269,605 A | * | 8/1966 | Silver | 222/135 |
| 3,349,967 A | * | 10/1967 | Schneller | 222/130 |
| 3,704,725 A | * | 12/1972 | Marand | 137/550 |
| 4,670,010 A | | 6/1987 | Dragone | |
| 4,711,375 A | * | 12/1987 | Mader et al. | 222/135 |
| 4,720,046 A | | 1/1988 | Morane | |
| 4,792,062 A | * | 12/1988 | Goncalves | 222/135 |
| 4,902,281 A | * | 2/1990 | Avoy | 604/191 |
| 5,002,048 A | * | 3/1991 | Makiej, Jr. | 128/200.23 |
| 5,005,736 A | * | 4/1991 | Portas | 222/135 |
| 5,074,322 A | | 12/1991 | Jaw | |
| 5,188,289 A | | 2/1993 | Pesho | |
| 5,560,545 A | | 10/1996 | Grogan et al. | |
| 5,588,566 A | * | 12/1996 | de Laforcade et al. | 222/402.11 |
| 5,605,288 A | | 2/1997 | McDonald | |
| 5,626,259 A | | 5/1997 | Maas et al. | |
| 5,634,571 A | * | 6/1997 | Cataneo et al. | 222/80 |
| 5,656,035 A | * | 8/1997 | Avoy | 604/191 |
| 5,678,765 A | * | 10/1997 | Dobbs et al. | 239/333 |
| 5,785,250 A | | 7/1998 | De Laforcade | |
| 5,808,553 A | | 9/1998 | Cunningham | |
| 5,819,987 A | | 10/1998 | Miller | |
| 5,833,121 A | * | 11/1998 | Gueret | 222/144.5 |

(Continued)

FOREIGN PATENT DOCUMENTS

DE 3604256 3/1987

OTHER PUBLICATIONS

Kronemyer, Bob, "Alcohol disinfection top choice for preventing nosocomial infections," Infections Disease News, Feb. 2000 (Copyright 2002, Revised Jun. 20, 2002), SLACK Incorporated.

Pittet D., "Compliance with hand disinfection and its impact on hospital-acquired infections," Journal of Hospital Infection, 48 Suppl A:S40-6, Aug. 2001, PubMed, MEDLINE.

(Continued)

*Primary Examiner*—Frederick C. Nicolas
(74) *Attorney, Agent, or Firm*—Law Office of Karen Dana Oster, LLC

(57) ABSTRACT

One preferred embodiment of the present invention is directed to a convenient and efficient dispenser that includes at least one container and at least one nozzle for dispersing the contents of the container(s). In one preferred embodiment, first and second nozzles functionally associated with sterilization agent within the container are positioned to disperse the sterilization agent to first and second target points respectively, the first target point being distinct from the second target point. In another preferred embodiment of the present invention, a grid is positioned in front of the nozzle(s) so that a dispersement of sterilization agent from within the container(s) sterilizes the grid(s) when the nozzle(s) are activated. Yet another preferred embodiment of the present invention is directed to a multiple-mist dispenser that includes a dual chamber activation sleeve so that two nozzles are simultaneously actuable by depression of the dual chamber activation sleeve.

5 Claims, 7 Drawing Sheets

U.S. PATENT DOCUMENTS

| | | | | |
|---|---|---|---|---|
| 5,863,497 | A | 1/1999 | Dirksing | |
| 5,960,991 | A | 10/1999 | Ophardt | |
| 6,029,600 | A * | 2/2000 | Davis | 116/200 |
| 6,082,593 | A * | 7/2000 | Bordherds | 222/181.3 |
| 6,146,587 | A | 11/2000 | Morgan | |
| 6,189,810 | B1 | 2/2001 | Nerushai et al. | |
| 6,209,461 | B1 * | 4/2001 | Riffet et al. | 102/513 |
| 6,308,863 | B1 * | 10/2001 | Harman | 222/135 |
| 6,375,089 | B1 | 4/2002 | Taylor et al. | |
| 6,604,655 | B1 * | 8/2003 | Lee | 222/135 |
| 6,708,845 | B2 * | 3/2004 | Weng | 222/61 |

OTHER PUBLICATIONS

Fendler, Eleanor J. and Groziak, Patricial A., "Maximizing Hand-Hygiene Compliance to Improve Outcomes," infectioncontroltoday.com, 2002, Virgo Publishing, Inc.

"Report: Thousands die needlessly from hospital infections, " CNN.com/HEALTH, 2002, Associated Press.

Bazell, Robert, "Hospital infections a deadly threat: Many cases could be prevented with simple precautions," MSNBC Health News, 2002, MSNBC.

* cited by examiner

FIG. 8
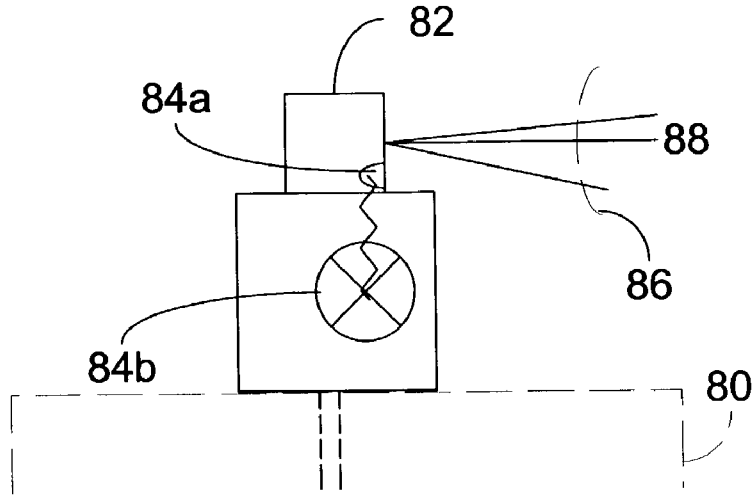
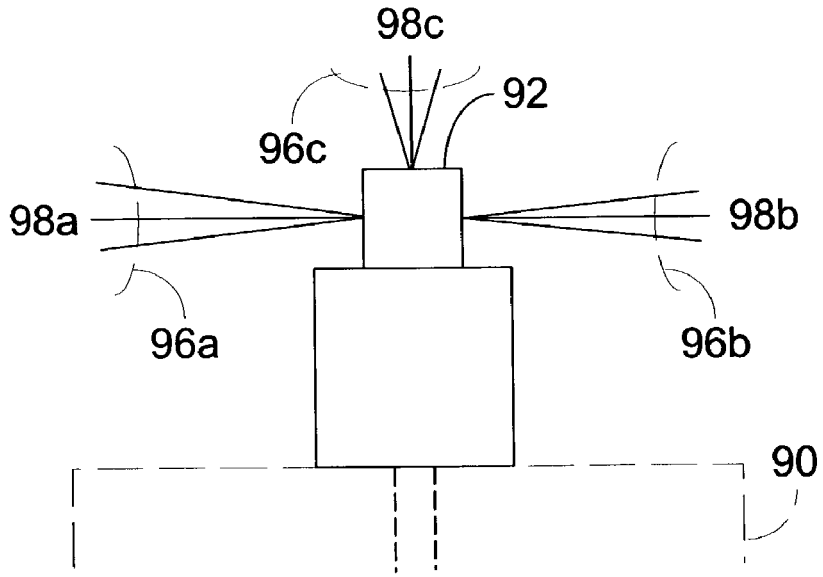
FIG. 9

MULTIPLE-MIST DISPENSER

BACKGROUND OF INVENTION

The present invention is directed to a convenient and efficient means for dispensing and more specifically to a multiple-mist dispenser for dispersing dispersement (such as a spray or mist) in a plurality of directions and/or having a net or wire grid in front of at least one dispersement nozzle.

Hand washing is extremely important to reduce the spread of germs, bacteria, and disease. Sometimes, however, soap and water are not readily available. In addition, regular washing with soap and water may irritate the skin. Several products on the market recognize this and attempt to provide alcohol based hand sanitizers (both rinses and gels) as is discussed in the article, "Maximizing Hand-Hygiene Compliance to Improve Outcomes: A New Tool for Infection Control," published in the November 2001 issue of *Infection Control Today* at http://www.infectioncontroltoday.com/articles/1 b1feat4.html.

There are also many patents directed to devices aimed at reducing the spread of germs, bacteria, and disease. U.S. Pat. No. 5,960,991 to Ophardt, for example, is directed to a fingerprint activated soap dispenser. U.S. Pat. No. 5,863,497 to Dirksing is directed to an electrostatic hand sanitizer. U.S. Pat. No. 5,808,553 to Cunningham is directed to an apparatus for enforcing hygiene. U.S. Pat. No. 5,074,322 to Jaw is directed to a structure of sterilizing hand dryer. U.S. Pat. No. 4,670,010 to Dragone is directed to a liquid-nebulizing device for the dermatological treatment of the hands. U.S. Pat. No. 3,220,424 to Nelson is directed to sanitizing equipment for sanitizing a person's hands. German Patent No. DE3604256 to Barsom is directed to a device for disinfecting, cleaning, and drying hands. The proliferation of devices emphasizes the need for an effective device for hand sterilization.

The best hand sanitizers and sterilization agents, however, do not work if the user promptly reinfects himself.

One example of a user reinfecting himself is when, after a thorough hand washing, a door with a contaminated handle must be opened. This usually occurs when a user washes his hands in the bathroom. Then, to leave the bathroom, he must open a door that has been handled by others who have not diligently sterilized his hands. This type of reinfection can sometimes be avoided by using a paper towel to open the door.

Another example of reinfection is when sterilized hands are used on a dirty "computer" controller such as a keyboard, mouse, button, touch screen, trackball, joystick, or other means for controlling a "computer." "Computer," for purposes of this disclosure, includes any controllable device, including, but not limited to, computers, games, copy machines, elevators, typewriters, adding machines, and any other device that can be controlled. Reinfection is extremely common when multiple people use a computer controller. This occurs when the "computer" is in public places such as libraries, public information kiosks, gaming facilities, stores, elevators, and other publicly accessible locations. This also occurs in offices where multiple people use the same workstation. Even a private controller may be contaminated by the user's own previous prior unsterilized usage. Once the user's sterilized hands touch the unsterilized controller, the user's hands become unsterilized.

Even the containers of the hand sanitizers can carry infections. If a user touches the container with unsterilized hands, the container becomes contaminated. The usual practice is for the user to pour hand sterilizer onto one hand. If the user puts down the container and rubs his hands together appropriately, he would have sterilized hands as long as he did not touch the unsterilized container again. The more likely scenario, however, is that he would sterilize one hand, touch the container, and then sterilize the other hand. This would leave the user with one unsterilized hand and, if the hands were brought together, possibly two unsterilized hands.

Some types of soap and hand sterilizers come in containers that are wall mounted. The user may actuate the wall-mounted devices, for example, by placing one hand under a spout and pressing a button with one or more fingers or thumb, placing his fingers under the spout and pushing a lever with the heel of his hand, or placing the palm of his hand under the spout and pulling forward with one or more of his fingers. These all require at least some contact with contaminated surfaces.

U.S. Pat. No. 5,785,250 to De Laforcade (the "De Laforcade reference") and U.S. Pat. No. 6,189,810 to Nerushai et al. (the "Nerushai reference") are directed to devices for spraying a liquid that has at least two nozzles. It should be noted, however, that the purpose of both of these devices is to provide a single and homogeneous spray. This is done by directing the sprays of the nozzles so that they at least partially overlap and/or join together. Such a configuration is not significantly functionally different from a single spray dispenser.

BRIEF SUMMARY OF THE INVENTION

The present invention is directed to a convenient and efficient means for hand sterilization and more specifically to a multiple-mist dispenser for dispersing a sterilization agent. The sterilization agent may be dispersed in a plurality of directions. Preferred embodiments of the present invention include one or both of two unique features: (1) a dual dispersement nozzle system (that may include multiple dispersement nozzles such as a sprayer, mister, or other disperser) that is capable of dispersing to two hands with a single activation and (2) a net or wire grid in front of, above, or below the dispersement (such as spray, mist, gel, lotion, foam, or other dispersement) that is sanitized with each activation.

One preferred embodiment of the present invention is directed to a convenient and efficient device for hand sterilization that includes at least one container, sterilization agent contained within the container, and first and second nozzles functionally associated with the sterilization agent. In this preferred embodiment, the first nozzle is positioned to spray the sterilization agent to a first target point and the second nozzle is positioned to spray the sterilization agent to a second target point. In this preferred embodiment, the first target point is distinct from the second target point.

Another preferred embodiment of the present invention is directed to a convenient and efficient device for hand sterilization that includes at least one container, sterilization agent contained within the at least one container, at least one nozzle functionally associated with the sterilization agent to disperse a dispersement of sterilization agent upon activation, and a grid in front of each nozzle. In this preferred embodiment, the dispersement of sterilization agent sterilizes the grid upon activation.

Yet another preferred embodiment of the present invention is directed to a multiple-mist dispenser that includes at least one container, a first nozzle functionally associated with the at least one container, first and second nozzles positioned to disperse dispersements, and a dual chamber activation sleeve having a first chamber and a second chamber. The first nozzle is positionable within the first chamber so that a first grid is in front of the first nozzle. The second nozzle is positionable within the second chamber so that a second grid is in front of the second nozzle. In this embodiment, the first nozzle and the second nozzle are simultaneously actuable by depression of the dual chamber activation sleeve.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

FIG. 8 is a side view of an exemplary embodiment of a sensor-activated nozzle of the present invention.

FIG. 9 is a side view of an exemplary embodiment of a triple dispersement-emitting nozzle of the present invention.

DETAILED DESCRIPTION OF THE INVENTION

Recognizing that the spread of germs can be reduced by frequent hand sterilization, the present invention seeks to make sterilization faster, more convenient, and cleaner. To that end, one feature of some of the embodiments of the present invention is that it allows a user to spray simultaneously both hands with a sterilization agent such as alcohol. Another feature of the present invention is that it could be placed in convenient locations (and in some cases, remain in those locations) that make sterilization convenient and desirable (e.g. nurses' stations, large kitchens, bathrooms). Yet another feature is that activation of the present invention requires only a minimum of contact (if any) with the surface of the dispenser and, in some embodiments, the surface is simultaneously sterilized.

The present invention is directed to a dispenser that might be used to transmit a dispersement of sterilization agent for purposes of sanitation. Although there are several preferred embodiments, each embodiment includes one or more of the following features: (1) a plurality of nozzles (which includes, for example, sprayers, misters, or dispersers) that, in one embodiment, are capable of simultaneously dispersing to two hands with a single activation and (2) a net or wire grid in front of the nozzle(s) such that the dispersement (which includes, for example, spray, mist, gel, lotion, foam, liquid, or other dispersements) sanitizes the grid with each activation. Additional features may also be incorporated that complement or enhance the present invention. These features may also be unique.

Before discussing the specific embodiments shown in FIGS. 1–11, some of the elements and features will be discussed individually.

Figure 2:
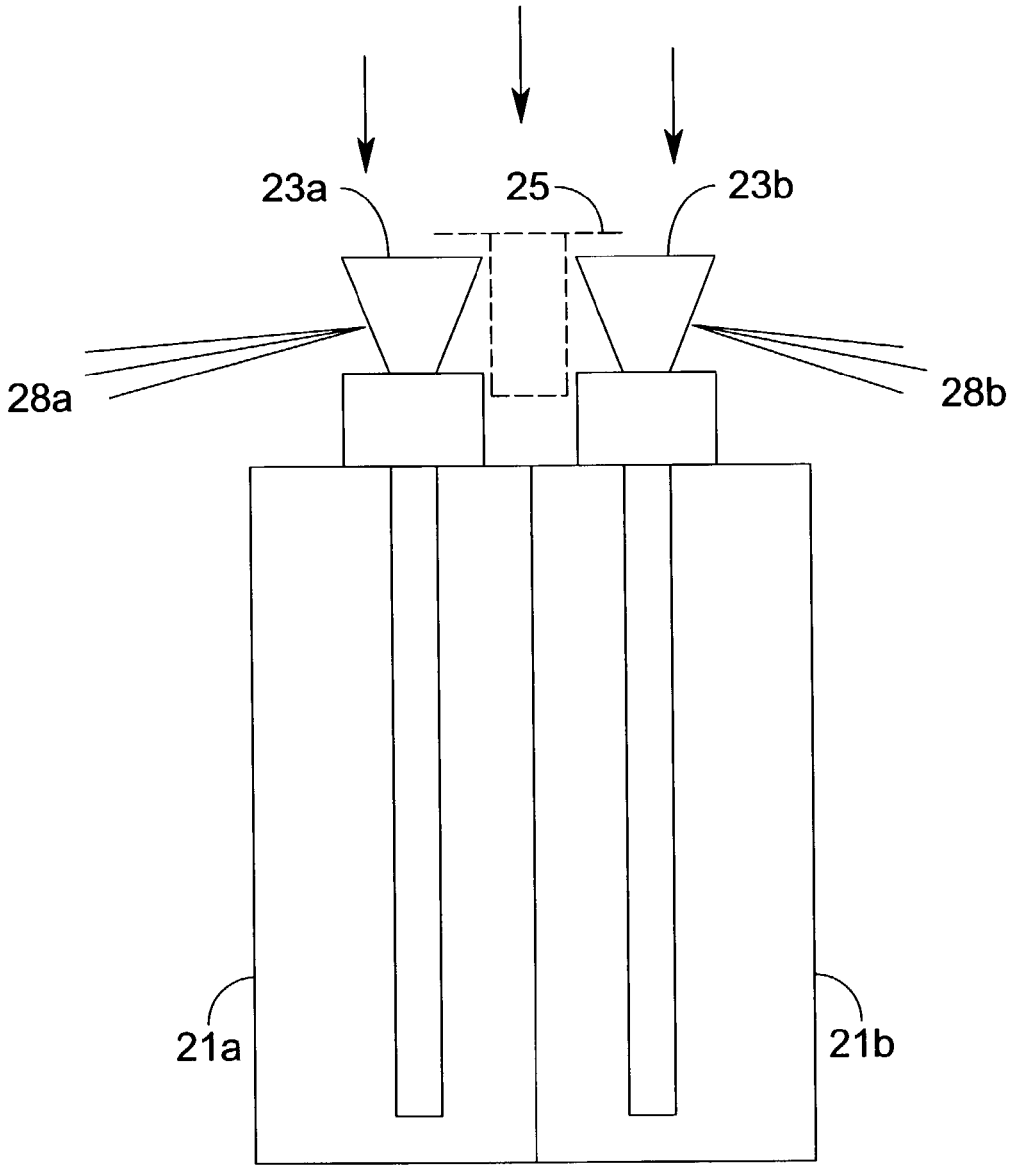
FIG. 2 is a side view of an exemplary embodiment of the present invention having two nozzles that can be selectively simultaneously activated by the depression of a removable and/or selectively activatable activation mechanism.
Figure 3:
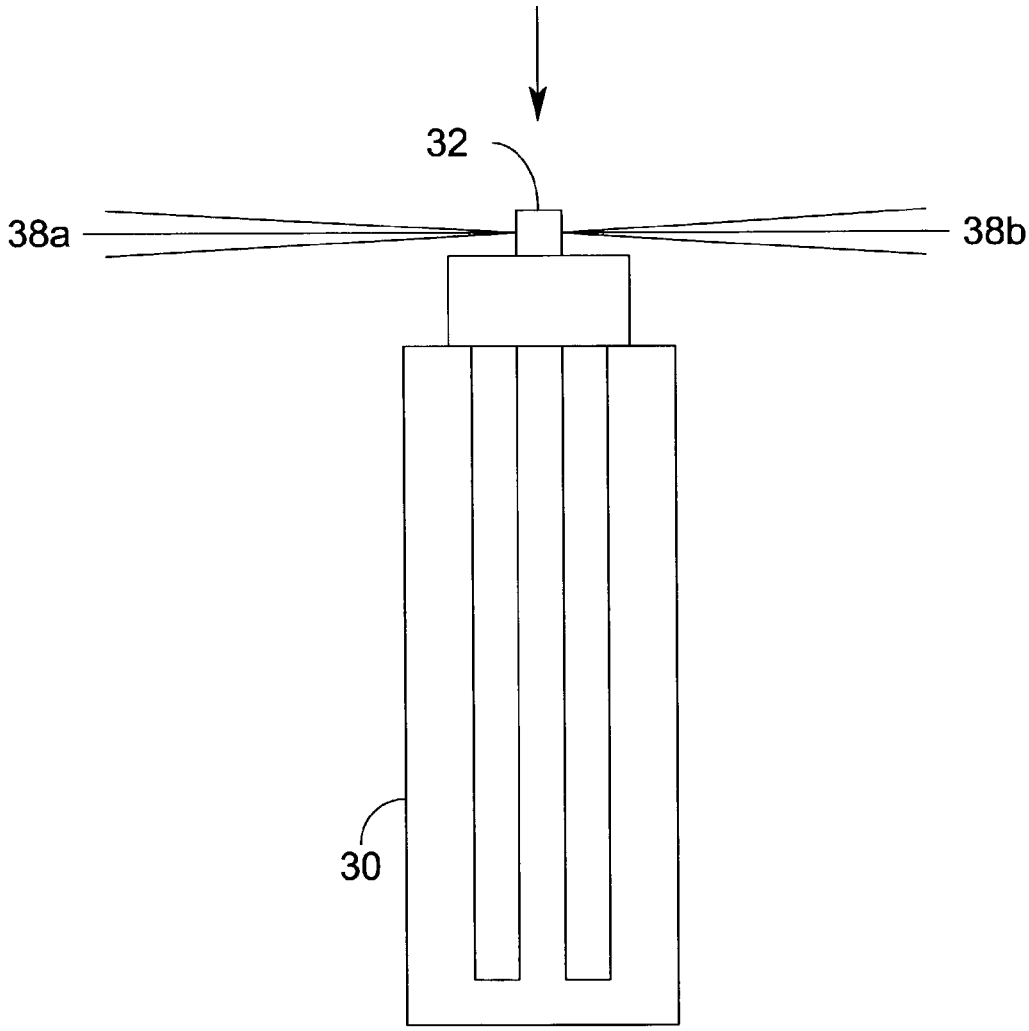
FIG. 3 is a side view of an exemplary embodiment of the present invention having a single nozzle with two outlets that are simultaneously activated by the depression of the nozzle.
Figure 4:
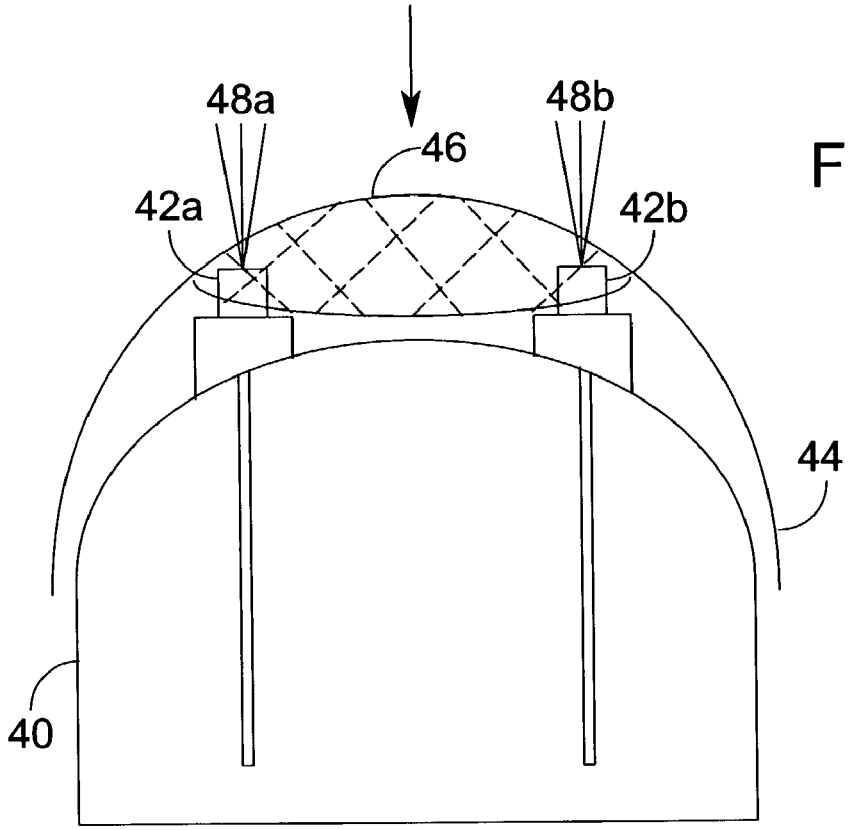
FIG. 4 is a side view of an exemplary embodiment of the present invention having two nozzles emitting parallel dispersements, the nozzles simultaneously activatable by the depression of a sleeve.
Figure 5:
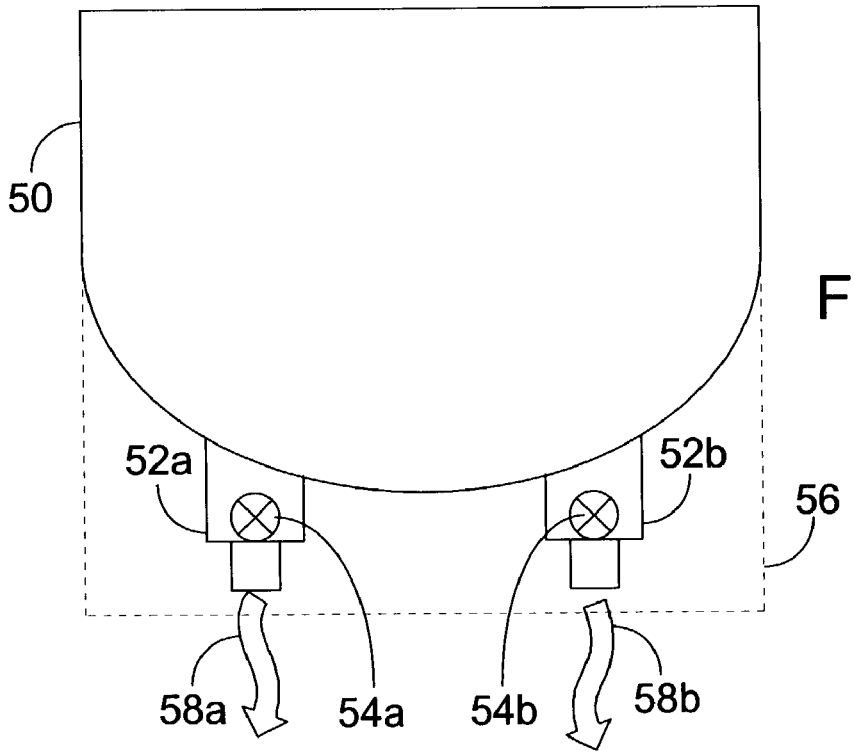
FIG. 5 is a side view of an exemplary embodiment of the present invention having two gravitationally activated nozzles that can be individually or simultaneously activated by one or more activation mechanisms.

The present invention preferably includes at least one container or reservoir such as a dual container (20*a*, 20*b* of FIG. 1 or 21*a*, 21*b* of FIG. 2) or a single container (30 of FIG. 3, 40 of FIG. 4, or 50 of FIG. 5). Alternatively, a single reservoir for multiple units may be used so that only one container needs to be refilled or replaced. This alternative embodiment would be especially practical in a situation such as a bathroom with multiple sinks with a separate unit associated with each sink, multiple outhouses with units mounted on the interior or exterior wall thereof, in front of multiple patients' rooms in a hospital hallway, or multiple computers or cash registers each having an associated unit. The container(s) are preferably suitable for storing sterilization agent. For exemplary purposes only, the containers may be made of plastic, metal, glass, or ceramic. In one preferred embodiment, the container is textured or coated with a persistent antimicrobial to resist contamination.

Figure 1:
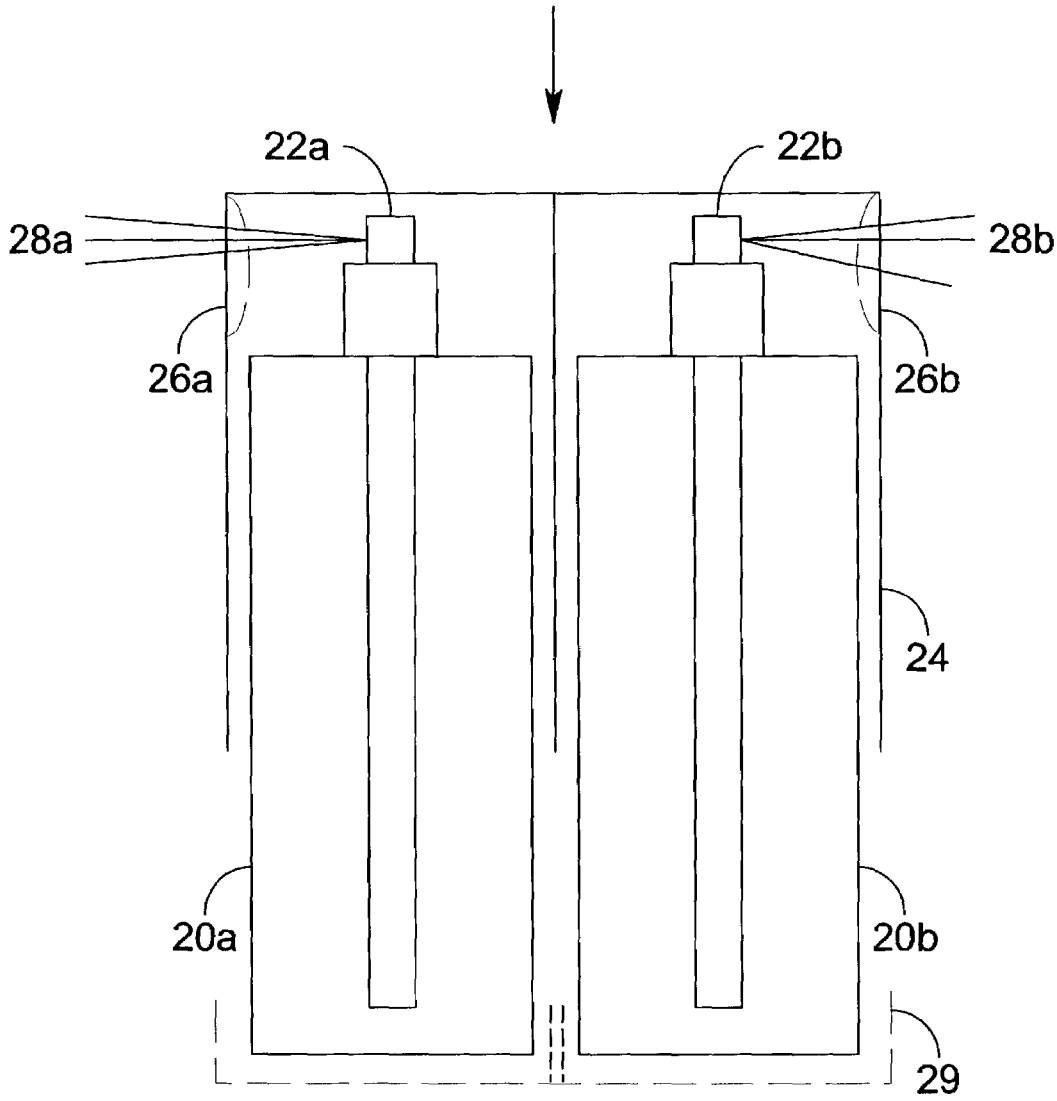
FIG. 1 is a side view of an exemplary embodiment of the present invention having two nozzles that can be simultaneously activated by the depression of a single, dual chamber activation sleeve.
Figure 6:
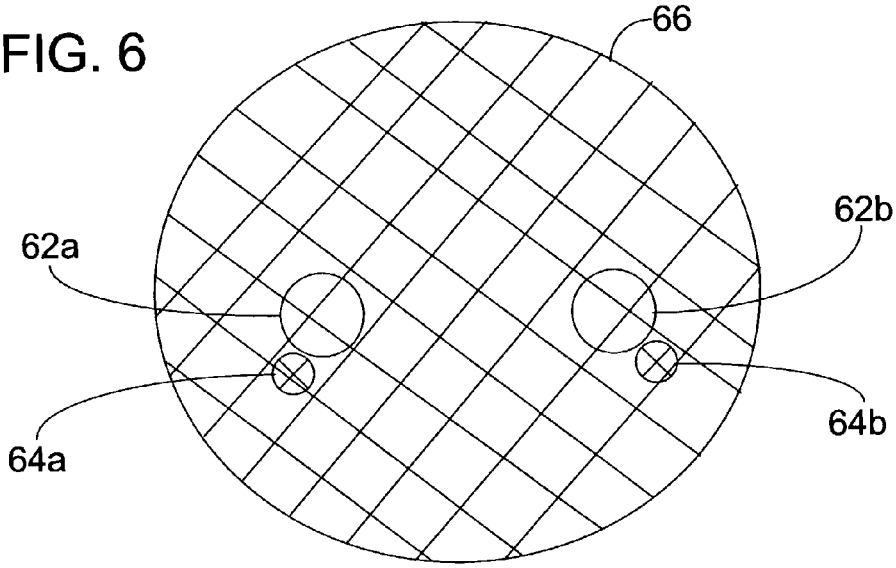
FIG. 6 is a plan view of a grid-covered aperture covering two nozzles.
Figure 7:
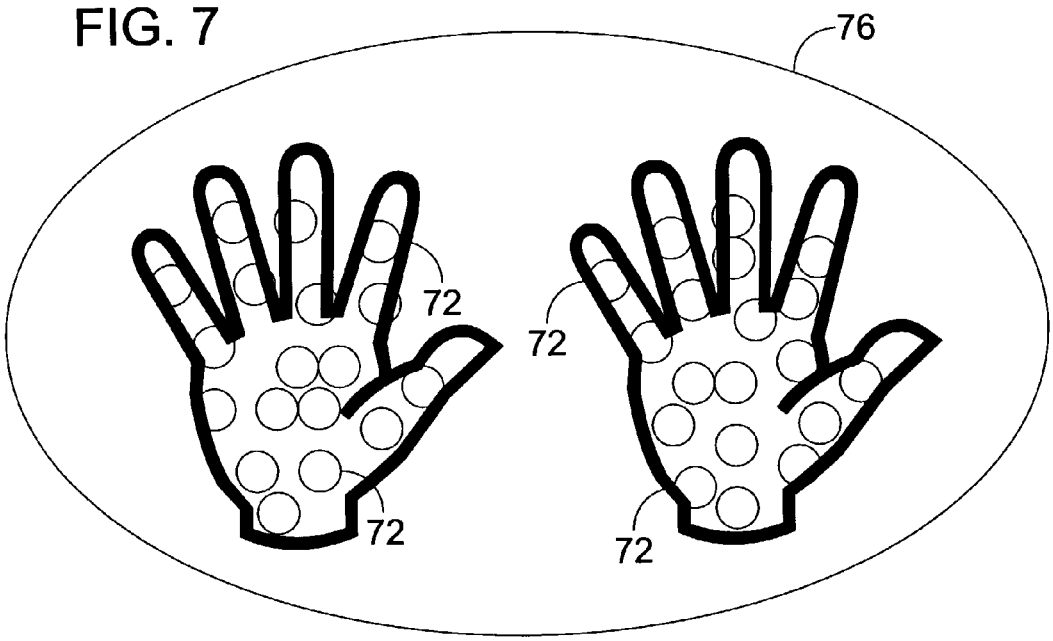
FIG. 7 is a plan view of a large aperture through which multiple nozzles could disperse dispersement.
Figure 10:
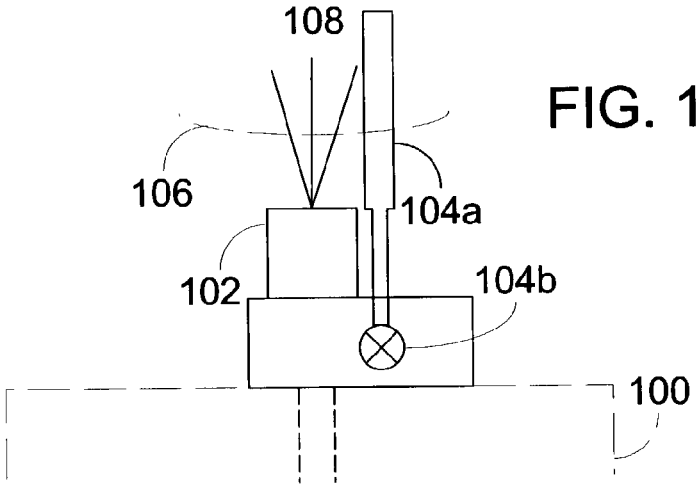
FIG. 10 is a side view of an exemplary embodiment of a mechanically activated nozzle of the present invention, the nozzle having an upwardly directed dispersement.

The present invention preferably includes at least two nozzles (which include sprayers, misters, or other types of dispersers) such as the two nozzles 22*a*, 22*b* of FIG. 1, downwardly directed two nozzles 23*a*, 23*b* of FIG. 2, the single nozzle 32 of FIG. 3 having two dispersement outlets, the two parallel nozzles 42*a*, 42*b* of FIG. 4, the downwardly dispersing nozzles 52*a*, 52*b* of FIG. 5, the nozzles 62*a*, 62*b* of FIG. 6, the multiple nozzles 72 of FIG. 7, the sensor activated nozzle 82 of FIG. 8, the triple spray emitting nozzle 92 of FIG. 9, or the mechanically activated nozzle 102 of FIG. 10. These nozzles may be any type of nozzle suitable for spraying, misting, or otherwise dispersing and may include, for example, spray nozzles, aerosol nozzles, misting nozzles, electrostatic emitters, foaming nozzles, or gravity fed nozzles. The nozzle(s) are functionally associated with the container(s) such that activation of the nozzle causes sterilization agent to be emitted from the nozzle(s). In one preferred embodiment, the functional association is created by a tube that extends from the nozzle into the sterilization agent. In yet another preferred embodiment such as that shown in FIG. 5, the functional association is that the nozzle provides an opening through which sterilization agent may exit the container(s) when the container is inverted, the container is squeezed, or the nozzles are otherwise activated.

Figure 11:
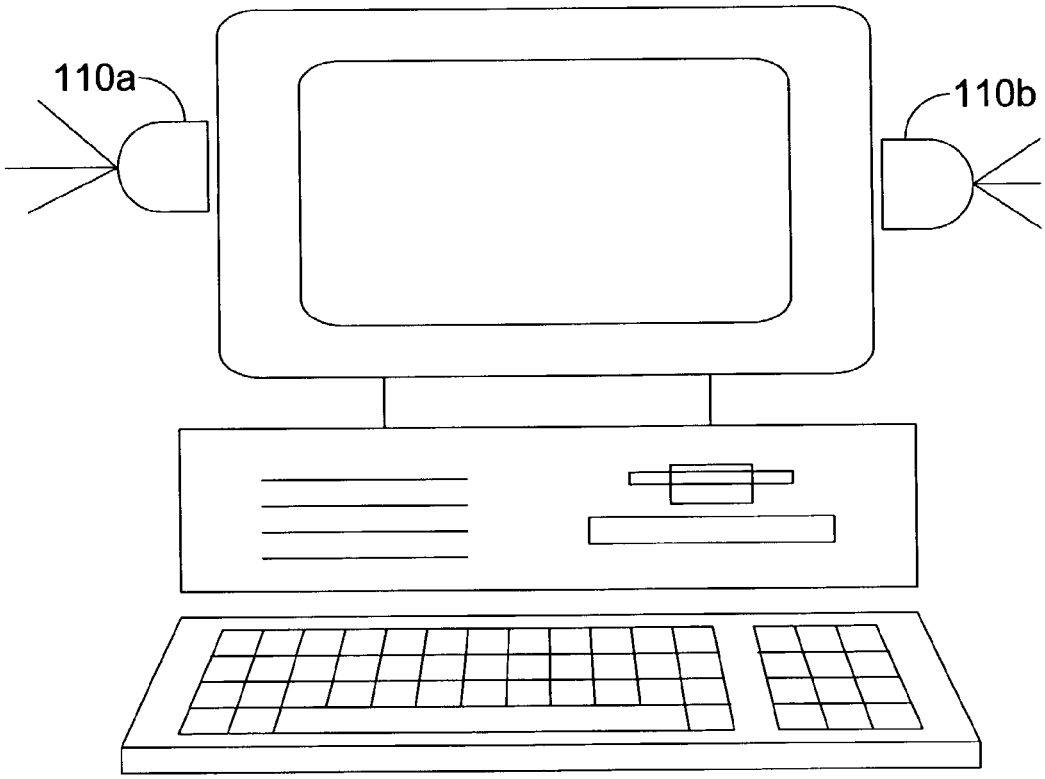
FIG. 11 is a front view of a computer screen having dispensers placed on opposite sides thereof.

The nozzles, in one preferred embodiment, are positioned so that the dispersement is directed in at least two directions such that the nozzles are capable of simultaneously spraying two hands with a single activation. More specifically, an embodiment having this feature would include a first nozzle functionally associated with the sterilization agent and a second nozzle functionally associated with the sterilization agent. The first nozzle would be positioned to disperse the sterilization agent to a first target point and the second nozzle would be positioned to disperse the sterilization agent to a second target point. It should be noted that the first target point would be distinct from the second target point. It should also be noted that the first and second nozzles could be replaced with a single dual sided or emitting nozzle such as the nozzle 32 of FIG. 3. As shown in FIGS. 1–3, in one preferred embodiment the target points are on substantially opposite sides of the nozzle(s) such that the dispersement is directed to both the user's left hand and right hand. FIG. 2 also shows that the nozzle(s) 23*a*, 23*b* may be directed slightly downward for safety. It should be noted that the embodiments of FIGS. 1 and 2 could be modified so that the nozzles are directed so that the dispersement from both nozzles exit in a parallel direction toward the user and the user activates these embodiments with his fingertips in a "pull-up"-type motion. As shown in FIGS. 4–7, in one preferred embodiment the target points are at least two points that are substantially adjacent each other. FIG. 11 shows that the target points may determined by the user's placement of the units 110*a*, 110*b* such as by placing the units 110*a*, 100*b* on opposite sides of a computer screen.

The present invention also preferably includes at least one activation mechanism such as the single, dual chamber activation sleeve 24 of FIG. 1, the removable and/or selectively activatable activation mechanism of FIG. 2, the nozzle activation mechanism 32 of FIG. 3, the sleeve 44 of FIG. 4, or a sensor activation mechanism 54*a*, 54*b* of FIG. 5. In the embodiment shown in FIG. 5 and detailed in FIGS. 6 and 8, the activation mechanism might be one or more activation sensors or systems 54*a*, 54*b*, 64*a*, 64*b*, 84*a*, 84*b* that can detect the presence of a user's hands so that no surface needs to be touched in order to activate the dispenser. Alternatively, the sensor or systems 54*a*, 54*b*, 64*a*, 64*b*, 84*a*, 84*b* might prevent activation of one or both nozzles unless the user's hands are properly positioned. FIG. 10 shows a mechanically activated nozzle 102 in which a mechanical activation member 104*a* extends beyond the nozzle 102 (and, if present, through the grid 106) so that contact with the mechanical activation member 104*a* causes an associated actuating member 104*b* to activate the nozzle 102 that emits a dispersement 108. This mechanical type of activation system would be particularly suitable for embodiments such as that shown in FIGS. 4–7.

In some preferred embodiments a net or wire grid is included in front of (grids 26*a*, 26*b* of FIG. 1, optional grid 86 of FIG. 8, or optional grids 96*a*, 96*b* of FIG. 9), above (grid 46 of FIG. 4, optional grid 96*c* of FIG. 9, or optional grid 106 of FIG. 10), or below (grid 56 of FIG. 5) the respective nozzle. In this embodiment, the net or wire grid is made of sterilizable material such as stainless steel, or porous ceramic or plastic. When the device is actuated, a dispersement of sanitization agent is emitted from the nozzle. The dispersement then passes through the net or wire grid and, in some embodiments, sterilizes the skin surface beyond. The sterilization agent substantially simultaneously sterilizes the net or wire grid. This sterilization occurs each time the respective nozzle is activated. It should be noted that the term "net or wire grid" may include any type of material having a plurality of apertures of any shape or size.

Another feature that may be incorporated into one or more of the aforementioned embodiments include a bell, buzzer, or other sound emitter that indicates that the device has been used (so as to let a parent know that a child has sanitized his hands or to let a supervisor know that medical or kitchen personnel have decontaminated his hands). A counter may also be added to record how many times the device has been activated over a given span of time.

Yet another feature that may be incorporated in the present invention is one or more textured and/or antimicrobial surfaces that resist contamination (for example, on the top of the sleeves). This surface may be used on the entire container and/or the activation mechanism.

Another feature that may be incorporated in the present invention is at least one smaller nozzle or an additional emitter from a multiple emitter nozzle. The smaller nozzle or additional emitter disperses upward toward the thumb or activation surface that actuates the nozzle. The upward dispersement disinfects a surface away from the main dispersements. This feature is shown in FIG. 9, but could be incorporated into most of the other embodiments.

Still another feature may be a proximity device that reminds a passerby to sterilize his hands. Such a proximity device may be motion activated so that movement causes the proximity device to activate. The reminder may take any form including, but not limited to, sound or light. The sound might be, for example, a voice recording reminding the passerby of the advantages of sterilizing his hands. A light reminder might be lit up and then go out after the present invention is used, after a predetermined period, or after the motion has ceased.

FIGS. 1–11 show exemplary embodiments that incorporate or detail one or more of the unique features of the present invention.

FIG. 1 shows a dual container 20*a*, 20*b* embodiment having two nozzles 22*a*, 22*b* that can be simultaneously activated by the depression of a single, dual chamber activation sleeve 24. The sleeve 24 has apertures that may be covered with grids 26*a*, 26*b* through which the dispersement 28*a*, 28*b* exits when the sleeve 24 is depressed. In use, the user places his hands on both sides of the sleeve 24 such that his palms are covering the apertures 26*a*, 26*b*. Using his thumb(s) to depress the sleeve 24, both nozzles simultaneously disperse dispersement 28*a*, 28*b* onto the palms of his hands. As shown the containers 20*a*, 20*b* are at least partially separated and a dividing portion of the sleeve is positioned between the two containers 20*a*, 20*b*. This embodiment allows for the containers 20*a*, 20*b* to be individually replaceable. This embodiment also allows standard spray bottles to be used in place of the individual containers 20*a*, 20*b*. An alternative embodiment could eliminate the sleeve such that both containers 20*a*, 20*b* are bound together, but the nozzles 22*a*, 22*b* are independently actuable (this would be similar to the embodiment of FIG. 2 with the activation mechanism 25 removed). An optional foot or holding mechanism 29 may also be included in this embodiment to hold the containers 20*a*, 20*b* in place. An alternative embodiment may include one or more additional upwardly directed nozzles with respective grid-covered apertures on the upper surface of the sleeve 24.

FIG. 2 shows a dual container 21*a*, 21*b* embodiment having two nozzles 23*a*, 23*b* that can be selectively simultaneously activated by the depression of a removable and/or selectively activatable activation mechanism 25. In this embodiment the dual containers 21*a*, 21*b* are bound or connected together or are a single divided container. It should be noted that the dual containers 21*a*, 21*b*, could be replaced with a single undivided container. The removable and/or selectively activatable activation mechanism 25 may be completely removed so that the nozzles 23*a*, 23*b* are only activatable independently. Alternatively, when the activation mechanism 25 is in place the nozzles 23*a*, 23*b* can be activated independently by depressing only a single nozzle 23*a* or 23*b* or together by depressing the removable and/or selectively activatable activation mechanism 25. If the activation mechanism 25 is removed, the user may use this embodiment by placing either or both of his hands on the side(s) of the dual container 21*a*, 21*b* and using his thumbs to independently depress the nozzles 23*a*, 23*b* so that one or both nozzles 23*a*, 23*b* disperse dispersement 28*a*, 28*b* onto the palm(s) of his hand(s). If the activation mechanism 25 is left in place, one way that the user may use this embodiment is to place his hands on both sides of the dual container 21*a*, 21*b* and use his thumb(s) to depress the activation mechanism 25 so that both nozzles 23*a*, 23*b* simultaneously disperse dispersement 28*a*, 28*b* onto the palms of both of his hands. Another way that the user may use this embodiment is to place either or both of his hands on the side(s) of the dual container 21*a*, 21*b* and use his thumbs to independently depress the nozzles 23*a*, 23*b* so that one or both nozzles 23*a*, 23*b* disperse dispersement 28*a*, 28*b* onto one or both of the palm(s) of his hand(s).

FIG. 3 shows a single container 30 embodiment having a single nozzle 32 with two outlets that are simultaneously activated by the depression of the nozzle 32. In this embodiment the nozzle 32 itself acts as the activation mechanism. The dispersement 38*a*, 38*b* exits on both sides of the nozzle 32 when it is depressed. An additional sleeve might be added in an alternative embodiment so that the user could correctly position his hands. Further, this embodiment could be modified to have a nozzle such as that shown in FIG. 9 so that an additional dispersement exits upward.

FIG. 4 shows an alternative embodiment having a single container 40 and two nozzles 42*a*, 42*b* that can be simultaneously activated by the depression of a sleeve 44. The activation sleeve 44 has a single net or wire grid covered aperture 46 (also shown in FIG. 6 as aperture 66 with nozzles 62*a*, 62*b*) through which the dispersement 48*a*, 48*b* exits when the sleeve 44 is depressed. In this embodiment the dispersement 48*a*, 48*b* exits upward, downward, or sideways (with some modification to the mechanical pump) in parallel directions. This embodiment is particularly suitable to wall mounting such that the user places both hands (or in an alternative, single nozzle embodiment, one hand) over the grid and activates the nozzle(s). Alternative embodiments may include one or more activation sensors 64*a*, 64*b* (FIG. 6) or mechanical activation members 104*a* (FIG. 10). This embodiment could be used on the top or side of a computer screen, on a car dashboard, on a desk, or in or under a drawer (such as a desk drawer or a bank teller's drawer).

FIG. 5 shows an alternative embodiment having a single container 50 and two gravitationally activated nozzles 52*a*, 52*b* that can be individually or simultaneously activated by one or more activation mechanisms 54*a*, 54*b*. The activation mechanisms 54*a*, 54*b* could be, for example, sensor activation systems such as those shown in and discussed in conjunction with FIG. 8 and/or remote mechanical activation systems such as those shown in and discussed in conjunction with FIG. 10. This embodiment is shown as having gravitationally activated nozzles 52*a*, 52*b* through which the dispersement (such as gel, lotion, spray, or mist) 58*a*, 58*b* exits downward. A net or wire grid 56 over an aperture may be used to prevent the nozzles 52*a*, 52*b* from being touched, but still allows the dispersement 58*a*, 58*b* to exit when the sensor activation mechanism(s) 54*a*, 54*b* is activated. It should be noted that the grid 56 is in fixed relation to the container 50 and nozzles 52*a*, 52*b*. This embodiment could be used, for example, under a shelf or a drawer (such as a desk drawer or a bank teller's drawer).

As mentioned above, FIG. 6 shows a grid-covered aperture 66 with nozzles 62*a*, 62*b*. As the sterilization agent exits the nozzles 62*a*, 62*b*, it would sterilize the grid 66. The grid 66 covering of the nozzles 62*a*, 62*b* could be directly in front of, above, or below the nozzles depending on the orientation of the container(s). The activation mechanisms 64*a*, 64*b* could be, for example, sensor activation systems such as those shown in and discussed in conjunction with FIG. 8 and/or remote mechanical activation systems such as those shown in and discussed in conjunction with FIG. 10. FIG. 6 may be an exemplary view looking toward the nozzles of other embodiments such as those shown in FIGS. 4 and 5.

FIG. 7 shows a large aperture 76 through which multiple nozzles 72 could disperse dispersement. In this embodiment, each nozzle 72 may be independently actuable by activation members associated with each nozzle 72. The activation mechanisms could be, for example, sensor activation systems such as those shown in and discussed in conjunction with FIG. 8 and/or remote mechanical activation systems such as those shown in and discussed in conjunction with FIG. 10. Placement of a single hand would only actuate those nozzles 72 directly opposite the hand. Similarly, small hands would not actuate as many nozzles 72 as large hands. This embodiment would be suitable for use in a public place such as a bathroom or an outhouse where multiple sizes of hands were expected to use the device. It should be noted that the aperture 76 might be a grid-covered aperture 76.

FIG. 8 shows a container 80 with an exemplary sensor activated nozzle 82 that is controlled by a sensor system 84*a*, 84*b*. The activation mechanism might be one or more activation sensors 84*a* that can detect the presence of a user's hands so that no surface needs to be touched in order to activate the dispenser. A functionally connected actuation member 84*b* would activate the nozzle 82 to release the dispersement 88 when the associated sensor 84*a* detected the presence of a user's hands. Alternatively, the sensor 84*a* and activation member 84*b* might prevent activation of one or both nozzles unless the user's hands are properly positioned. In this embodiment, there might be a mechanical activation member that is used in combination with the sensor 84*a*. Specifically, both the mechanical activation member (e.g. sleeve, button, trigger, pump, or other actuator) must be activated and additionally the sensor 84*a* must sense a user's hands before dispersement 88 will exit the nozzle 82. It should be noted that the orientation of the sensor 84*a* and the direction of the dispersement 88 could be adapted for their intended purpose. This embodiment may also be used with an optional grid 86.

FIG. 9 shows an exemplary triple dispersement-emitting nozzle 92. Particularly unique to this nozzle 92 is that it includes an additional emission point that disperses upward toward the thumb surface that actuates the nozzle 92 thus disinfecting a surface away from the main dispersement(s). This embodiment may also be used with optional grids 96*a*, 96*b*, 96*c*.

FIG. 10 shows an exemplary mechanically activated nozzle 102 that is controlled by a mechanical activation system 104*a*, 104*b*. The mechanically activated nozzle 102 may include a mechanical activation member 104*a* that extends beyond the nozzle 102 (and, if present, through the grid 106) so that contact with the mechanical activation member 104*a* causes an associated actuating member 104*b* to activate the nozzle 102 that emits a dispersement 108. This mechanical type of activation system would be particularly suitable for embodiments such as that shown in FIGS. 4–7. This embodiment may also be used with an optional grid 106.

FIG. 11 shows yet another embodiment in which the dispensers 110*a*, 101 *b* are placed on opposite sides of a computer screen (or other machine such as a cash register). As shown in FIG. 11, the target points may determined by the user's placement of the units 110*a*, 110*b*.

Although the product is discussed in terms of a dispenser that might be used to disperse a dispersement of sterilization agent for purposes of sanitation, the product may be used for alternative purposes including, but not limited to spraying of other products (e.g. skin emollient for skin treatment in harsh (e.g., dry, sun-bright) environments, sunscreens, and insect-repellants).

It should be noted that the nozzle(s) might spray (sprayer), mist (mister), and disperse (disperser). The terms spray, mist, and dispersement, are used as examples throughout the specification and claims, however, embodiments described as spraying may also be misting and/or dispersing. Similarly, embodiments described as misting may also be spraying and/or dispersing and embodiments described as dispersing may also be misting and/or spraying.

It should be noted that some of the mechanical features of the present invention have been omitted or only briefly mentioned. For example, how the dual chamber activation sleeve 24 stays on the dual container 20*a*, 20*b* is not discussed because it could be merely placed thereon or could be held on in an infinite number of ways that would be known to those skilled in the art. Similarly, how the various dispersement nozzles work are not specifically detailed as such information would be unique to each type of dispersement nozzle and would be known to those skilled in the art.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A multiple-mist dispenser, said dispenser comprising:

(a) at least one container;

(b) a first nozzle functionally associated with said at least one container, said first nozzle positioned to disperse a first dispersement to a first target point;

(c) a second nozzle functionally associated with said at least one container, said second nozzle positioned to disperse a second dispersement to a second target point; and (d) a dual chamber activation sleeve having a first chamber and a second chamber;

(e) a first grid defined within said first chamber;

(f) a second grid defined within said second chamber;

(g) said first nozzle being positioned within said first chamber so that said first grid is in front of said first nozzle;

(h) said second nozzle being positioned within said second chamber so that said second grid is in front of said second nozzle; and (i) said first nozzle and said second nozzle being simultaneously actuable by depression of said dual chamber activation sleeve.

2. The dispenser of claim 1, said first target point being distinct from said second target point.

3. The dispenser of claim 1, said first target point in a first direction from said at least one container, said second target point in a second direction from said at least one container, said first direction separated by more than 100 degrees from said second direction.

4. The dispenser of claim 1, said first target point in a first direction from said at least one container, said second target point in a second direction from said at least one container, said first direction parallel to said second direction.

5. The dispenser of claim 1, said at least one container being a first container and a second container, said first nozzle being functionally associated with said first container and said second nozzle being functionally associated with said second container.

* * * * *